US007101016B2

(12) United States Patent
Lopez et al.

(10) Patent No.: US 7,101,016 B2
(45) Date of Patent: Sep. 5, 2006

(54) ADJUSTMENT OF FLUID-EJECTION ENERGY TO YIELD FLUID DROP MASSES HAVING CONSISTENT RATIO

(75) Inventors: Mathew G. Lopez, Escondido, CA (US); Mark A. Overton, Escondido, CA (US); Michael Gray, Encinitas, CA (US)

(73) Assignee: Hewlett-Packard Company, Houston, TX (US)

( * ) Notice: Subject to any disclaimer, the term of this patent is extended or adjusted under 35 U.S.C. 154(b) by 367 days.

(21) Appl. No.: 10/760,045

(22) Filed: Jan. 18, 2004

(65) Prior Publication Data

US 2005/0156976 A1 Jul. 21, 2005

(51) Int. Cl.
*B41J 29/393* (2006.01)

(52) U.S. Cl. ..... 347/19; 358/504

(58) Field of Classification Search ..... 347/19, 347/16, 15, 5; 358/504
See application file for complete search history.

(56) References Cited

U.S. PATENT DOCUMENTS 5,581,284 A * 12/1996 Hermanson ..... 347/43
5,610,637 A * 3/1997 Sekiya et al. ..... 347/10
6,302,511 B1 * 10/2001 Neese et al. ..... 347/19
2001/0024583 A1 9/2001 Kawatoko

FOREIGN PATENT DOCUMENTS

| | | |
|---|---|---|
| EP | 1292117 | 3/2003 |
| EP | 1364795 | 11/2003 |
| EP | 1398956 | 3/2004 |

OTHER PUBLICATIONS

European Search Report dated May 10, 2005.

* cited by examiner

*Primary Examiner*—Lamson Nguyen

(57) ABSTRACT

A method of an embodiment of the invention is disclosed that determines calibration factors for a fluid-ejection mechanism that is capable of ejecting differently colored fluids onto media. The energy used to eject fluid for each of at least one of the fluid colors is adjusted based on the calibration factors, so that fluid drop ejections of the fluid colors yield fluid drop masses having a consistent ratio.

4 Claims, 7 Drawing Sheets

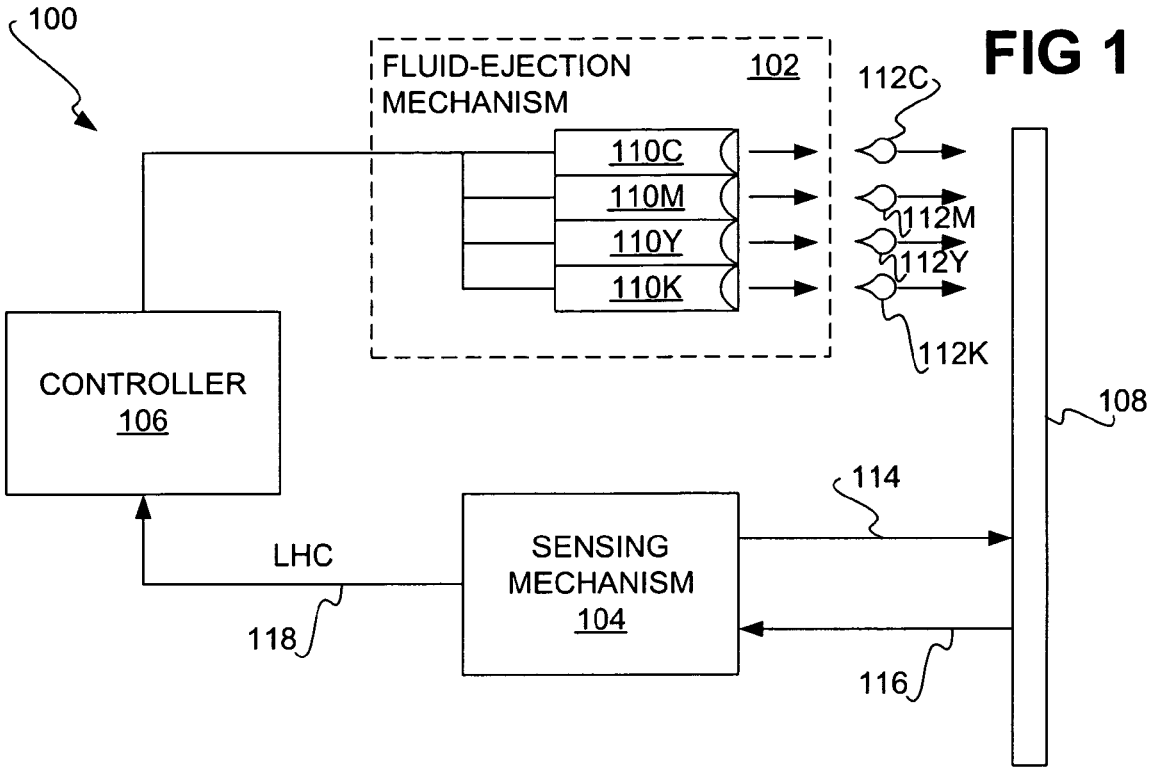
FIG 1
FIG 2
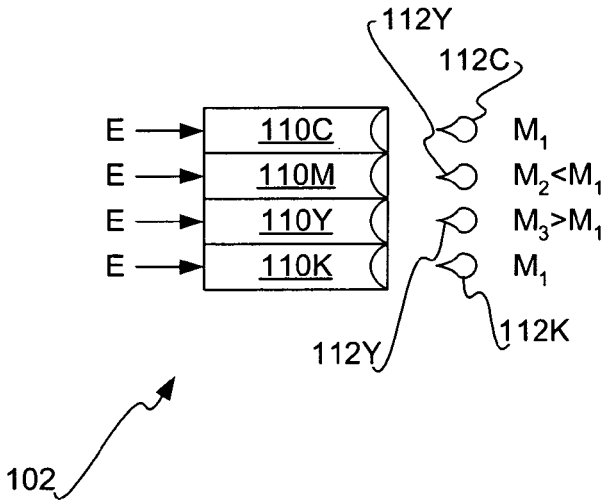

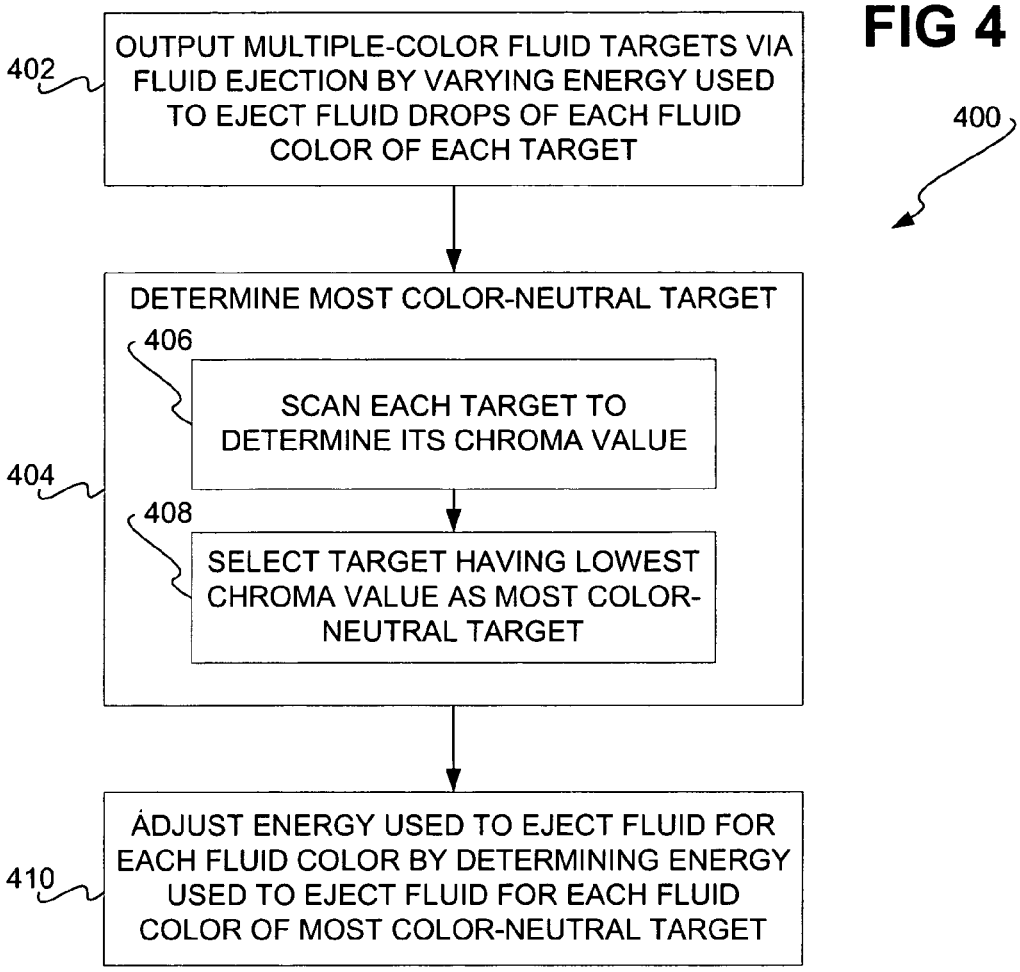
FIG 4
400
402
OUTPUT MULTIPLE-COLOR FLUID TARGETS VIA FLUID EJECTION BY VARYING ENERGY USED TO EJECT FLUID DROPS OF EACH FLUID COLOR OF EACH TARGET
404
DETERMINE MOST COLOR-NEUTRAL TARGET
406
SCAN EACH TARGET TO DETERMINE ITS CHROMA VALUE
408
SELECT TARGET HAVING LOWEST CHROMA VALUE AS MOST COLOR-NEUTRAL TARGET
410
ADJUST ENERGY USED TO EJECT FLUID FOR EACH FLUID COLOR BY DETERMINING ENERGY USED TO EJECT FLUID FOR EACH FLUID COLOR OF MOST COLOR-NEUTRAL TARGET

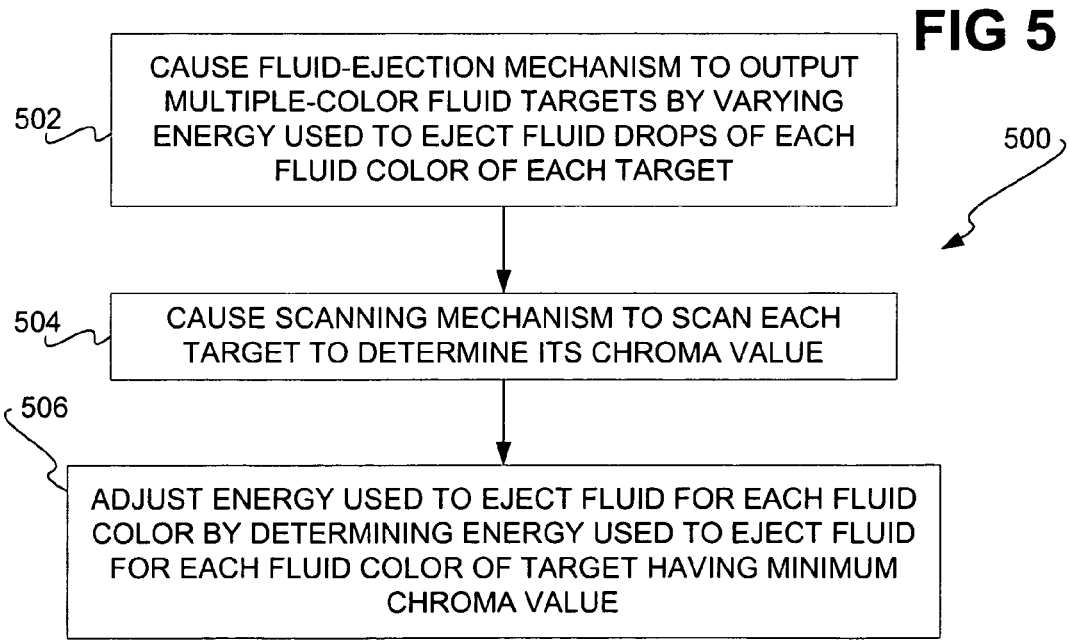
FIG 5
500
502
CAUSE FLUID-EJECTION MECHANISM TO OUTPUT MULTIPLE-COLOR FLUID TARGETS BY VARYING ENERGY USED TO EJECT FLUID DROPS OF EACH FLUID COLOR OF EACH TARGET
504
CAUSE SCANNING MECHANISM TO SCAN EACH TARGET TO DETERMINE ITS CHROMA VALUE
506
ADJUST ENERGY USED TO EJECT FLUID FOR EACH FLUID COLOR BY DETERMINING ENERGY USED TO EJECT FLUID FOR EACH FLUID COLOR OF TARGET HAVING MINIMUM CHROMA VALUE

ADJUSTMENT OF FLUID-EJECTION ENERGY TO YIELD FLUID DROP MASSES HAVING CONSISTENT RATIO

BACKGROUND

Inkjet printers have become popular for printing on media, especially when precise printing of color images is needed. For instance, such printers have become popular for printing color image files generated using digital cameras, for printing color copies of business presentations, and so on. Industrial usage of inkjet printers has also become common for high-speed color printing on large numbers of items. An inkjet printer is more generically a fluid-ejection device that ejects drops of fluid, such as ink, onto media, such as paper.

To ensure the highest quality of inkjet printing output, many variables usually have to be considered. One such variable is the fluid drop mass, or size, of ink drops that each inkjet printhead outputs. An inkjet printer may include a number of different printheads, corresponding, for instance, to a particular color model, such as the cyan-magenta-yellow-black (CMYK) color model, so that nearly any color can be achieved by outputting various combinations of the differently colored inks. For proper color matching, the fluid drop masses output by the different printheads should have constant, or consistent, ratios with respect to one another.

However, manufacturing, environmental, and other variations and factors can affect the fluid drop masses output by the inkjet printheads of inkjet printers. Different printheads within the same inkjet printer may output ink drops that have different fluid drop masses. An inkjet printhead outputting cyan ink, for instance, may output cyan ink drops that have different drop masses than those of magenta ink drops output by another inkjet printhead. Such a mismatch in ink drop masses within the same printer can result in less than optimal inkjet printing output quality.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

FIG. 1 is a diagram of a rudimentary fluid-ejection assembly, according to an embodiment of the invention.

FIG. 2 is a diagram depicting how the same fluid-ejection energy may result in fluid drops of different masses, or sizes, over different printheads, in accordance with which embodiments of the invention may be practiced.

FIG. 4 is a flowchart of a method to adjust fluid-ejection energy to yield substantially identical fluid drop masses for different fluid colors, according to an exemplary embodiment of the invention.

FIG. 5 is a flowchart of a method for performance by the fluid-ejection assembly of FIG. 1 to adjust fluid-ejection energy to yield substantially identical fluid drop masses, according to an exemplary embodiment of the invention.

DETAILED DESCRIPTION OF THE DRAWINGS

Figure 3:
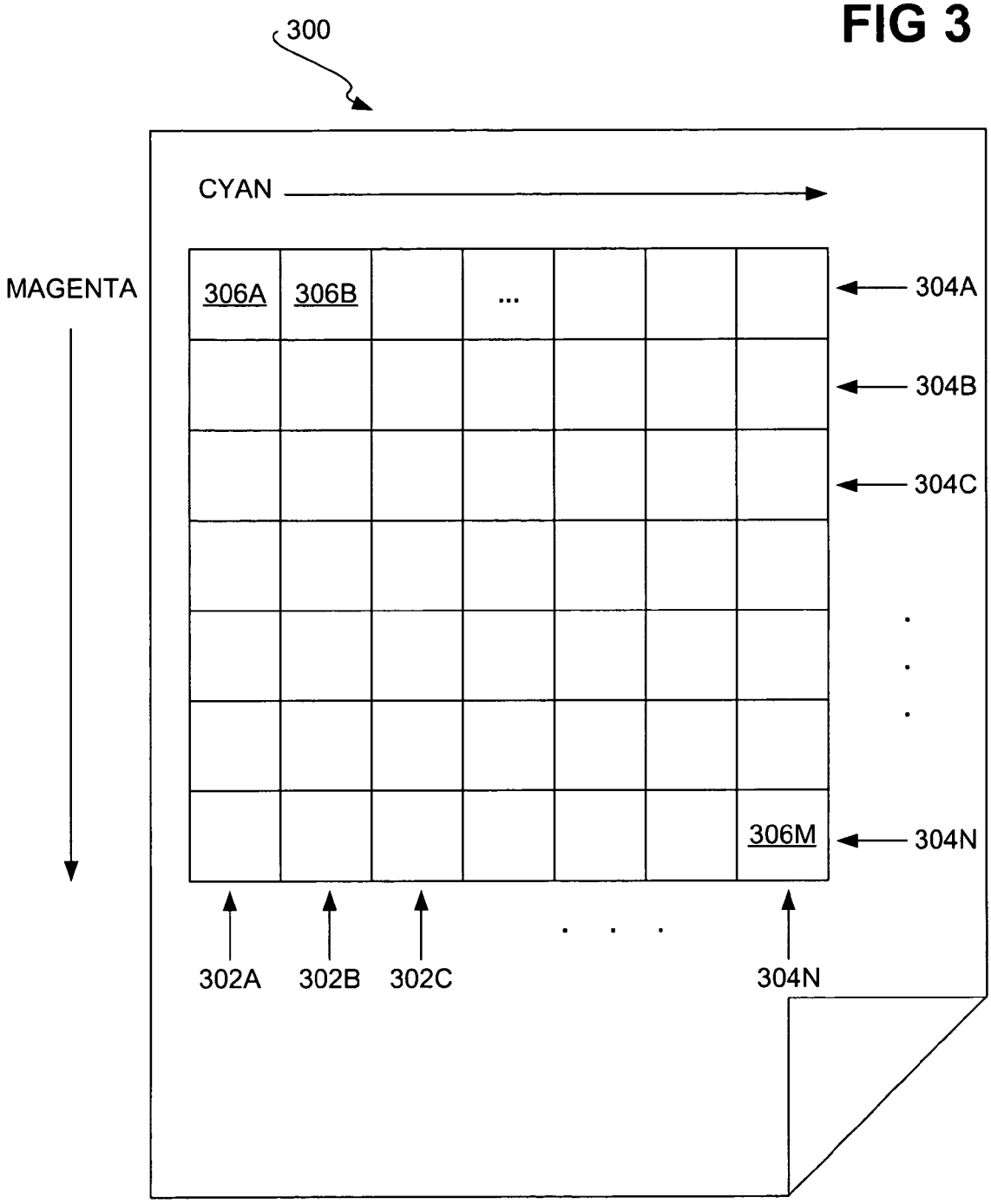
FIG. 3 is a diagram of an example grid of multiple-color fluid targets output onto media via fluid ejection, according to an exemplary embodiment of the invention.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Fluid-Ejection Assembly and Energy Modulation to Vary Fluid Drop Mass

FIG. 1 shows a rudimentary fluid-ejection assembly 100, according to an embodiment of the invention. The fluid-ejection assembly 100 includes a fluid-ejection mechanism 102, a sensing mechanism 104, and a controller 106. The fluid-ejection assembly 100 may be an inkjet-printing assembly, and may be a part of a fluid-ejection device, such as an inkjet-printing device. The fluid-ejection mechanism 102 is depicted as including printheads 110C, 110M, 110Y, and 110K, collectively referred to as the printheads 110, and which may be inkjet printheads. The printheads 110C, 110M, 110Y, and 110K eject cyan fluid drops 112C, magenta fluid drops 112M, yellow fluid drops 112Y, and black fluid drops 112K, respectively, which are collectively referred to as the fluid drops 112, and which may be ink drops. The fluid drops 112 are ejected towards media 108, such as paper, or another type of media. The printheads 110 thus eject differently colored fluids 112 in accordance with the cyan-magenta-yellow-black (CMYK) color model in FIG. 1. However, alternatively, the printheads 110 may eject differently color fluids 112 in accordance with a different color model.

The sensing mechanism 104 may include or be an optical sensor that emits light 114 towards the media 108, and detects, or senses, light 116 that is reflected back off the media 108 as a result. The sensing mechanism 104 may provide luminance, hue, and chroma values to the controller 106, as indicated by the arrow 118, based on the part of the media 108 that the light 114 is incident to, as reflected back as the reflected light 116. The controller 106 controls the energy levels that cause the printheads 110 of the fluid-ejection mechanism 102 to fire, or eject ink, where the printheads 110 may be thermal-inkjet (TIJ), piezoelectric, or another type of printheads. The controller 106, based on the chroma or other values provided by the sensing mechanism 104, is able to individually adjust the energy used to eject the colored fluids 112 by the printheads 110 of the fluid-ejection mechanism 102, as described in detail later in the detailed description. The controller 106 may include hardware, software, or a combination of hardware and software.

FIG. 2 shows an example of the printheads 110 of the fluid-ejection mechanism 102 ejecting the fluid drops 112 such that the drops 112 have different fluid drop masses, or sizes, even though the same energy is used to cause each of the printheads 110 to eject its corresponding one of the drops 112, in conjunction with which embodiments of the invention may be implemented. Each of the printheads 110 receives an energy E to eject its corresponding one of the drops 112. The printheads 110C and 110K eject fluid drops 112C and 112K, respectively, that have the same drop mass $M_1$. The printhead 110M ejects the fluid drop 112M that has a drop mass $M_2$ that is less than the drop mass $M_1$. The printhead 110Y ejects the fluid drop 112Y that has a drop mass $M_3$ that is greater than the drop mass $M_1$.

That is, the printheads 110M and 110Y eject fluid drops 112M and 112Y that have drop masses that differ from the drop masses of the fluid drops 112C and 112K ejected by the printheads 110C and 110K, even though the same energy E is used to cause each of the printheads 110 to eject its corresponding one of the drops 112. This can affect print quality, because it is generally presumed that the drop sizes, or drop masses, of the fluid drops 112 ejected by the different printheads 110 are substantially the same size. Embodiments of the invention that correct this problem are described in the succeeding sections of the detailed description.

Exemplary Embodiment for Ensuring Substantially Identical Fluid Drop Mass

FIG. 3 shows a grid 300 of multiple-color fluid targets 306A, 306B, . . . , 306K ejected on the media 108 that have different combinations of cyan fluid and magenta fluid, and which is used to ensure that ejections of cyan fluid and magenta have substantially identical fluid drop masses, according to an embodiment of the invention. The multiple-color fluid targets 306A, 306B, . . . , 306K of the grid 300 are collectively referred to as the fluid targets 306. The amount of cyan fluid is adjusted over the columns 302A, 302B, 302C, . . . , 302N, collectively referred to as the columns 302, by varying the amount of energy used to eject cyan fluid drops within the targets 306 in each of the columns 302. Similarly, the amount of magenta fluid is adjusted over the rows 304A, 304B, 304C, . . . , 304N, collectively referred to as the rows 304, by varying the amount of energy used to eject magenta fluid drops within the targets 306 in each of the rows 304.

For instance, the amount of energy used to eject cyan fluid drops within the targets 306 in the column 302A is lower than the amount of energy used to eject cyan fluid drops within the targets 306 in the column 302B, the amount of energy used to eject cyan fluid drops within the targets 306 in the column 302B is lower than the amount of energy used to eject cyan fluid drops within the targets 306 in the column 302C, and so on. Similarly, the amount of energy used to eject magenta fluid drops within the targets 306 in the row 304A is lower than the amount of energy used to eject magenta fluid drops within the targets in the row 304B, the amount of every used to eject magenta fluid drops within the targets 306 in the row 304B is lower than the amount of energy used to eject magenta fluid drops within the targets 306 in the row 304C, and so on. Therefore, in each of the multiple-color fluid-drop targets 306, there is a unique combination of the energy used to eject cyan fluid and the energy used to eject magenta fluid.

The grid 300 of the multiple-color fluid targets 306 is achieved by having the printheads 110C and 110M of the fluid-ejection mechanism 102 eject fluid onto the media 108 as prescribed. Furthermore, each of the multiple-color fluid targets 306 has a combination of two colored fluids, cyan and magenta fluid, in FIG. 3 for illustrative and descriptive clarity. In actuality, each of the multiple-color fluid targets 306 has a combination of all the differently colored fluids that the printheads 110 of the fluid-ejection mechanism 102 are able to eject. In the case of the fluid-ejection mechanism 102, this means that in actuality the fluid-targets 306 would have different combinations of cyan, magenta, yellow, and black fluids, as can be appreciated by those of ordinary skill within the art.

The sensing mechanism 104 is employed to determine the most color-neutral target of the multiple-color fluid targets 306. This can be accomplished by measuring the chroma value of each of the fluid targets 306, and determining which of the targets 306 has the lowest, or minimum, chroma value. The most color-neutral target is the one of the fluid targets 306 that has substantially equal fluid drop masses of both cyan fluid and magenta fluid.

For example, the amount of energy used to eject the cyan fluid drops within the targets 306 in the columns 302A, 302B, 302C, . . . , 302N may be $E_A$, $E_B$, $E_C$, . . . , $E_N$, respectively. Similarly, the amount of energy used to eject the cyan fluid drops within the targets 306 in the rows 302A, 302B, 302C, . . . , 302N may also be $E_A$, $E_B$, $E_C$, . . . , EN, respectively. However, for a given amount of energy used to eject the cyan fluid drops and to eject the magenta fluid drops, the resulting fluid drop mass of the magenta fluid drops may be less than that of the cyan fluid drops. Thus, those fluid targets identified by the column 302A and the row 304A, the column 302B and the row 304B, and so on, resulting from using the same amount of energy to eject both cyan and magenta fluid drops, are not color neutral because the cyan fluid drops are larger than the magenta fluid drops in these targets.

For instance, it may be determined that the fluid target identified by the column 302B and the row 304C is the most color neutral, even though the amount of energy used to eject the magenta fluid drops in this target is greater than the amount of energy used to eject the cyan fluid drops in the target. Such a fluid target would nevertheless be most color-neutral target where the fluid drop masses, or sizes, of the cyan fluid drops and the magenta fluid drops are substantially equal to each other. Having substantially equal fluid drop masses within this fluid target means that the target yields a minimal chroma value by the sensing mechanism 104, such that it is selected as the most color-neutral fluid target.

The energy used to eject the cyan fluid drops within the most color-neutral target of the multiple-color fluid targets 306, and the energy used to eject the magenta fluid drops within this most color-neutral target, is stored by the controller 106 for subsequent ejections of cyan and magenta fluid drops by the printheads 110C and 110M of the fluid-ejection mechanism 102. That is, the controller 106 adjusts the energy used to eject cyan and magenta fluid by determining the energy used to eject cyan and magenta fluid within the most color-neutral target. Thereafter, when cyan and magenta fluid is to be ejected, the resulting cyan and magenta fluid drops have substantially identical fluid drop masses, or sizes.

FIG. 4 shows a method 400 for adjusting fluid-ejection energy to yield substantially identical fluid drop masses that summarizes and generalizes the foregoing description, according to an embodiment of the invention. Multiple-color fluid targets are output, via fluid ejection, by varying the energy used to eject fluid drops of each fluid color of each target (402). For instance, in the case of the example of FIG. 3, each of the fluid targets 306 has a different combination of cyan and magenta fluid, because each of the fluid targets 306 was generated using a different fluid-ejection energy for the cyan and magenta fluid. In the case of cyan, magenta, yellow, and black fluid, each multiple-color fluid target is output such that the energy used for each of these differently colored fluids varies over the targets.

Next, the most color-neutral multiple-color fluid target is determined (404). This can be accomplished by scanning each fluid target to determine its chroma value (406), and selecting the target having the lowest, or minimum, chroma value as the most color neutral target (408). Finally, the energy used to eject fluid for each fluid color is adjusted, by determining the energy used to eject fluid for each fluid color within the most color-neutral target (410). The energy determined and adjusted for each color of fluid is then used in subsequent fluid ejection so that substantially identical fluid drop masses are achieved.

FIG. 5 shows a method 500 that is consistent with the method 400, but which is performed by the controller 106 to achieve substantially identical fluid drop masses of differently colored fluids, according to an embodiment of the invention. The method 400 may thus be implemented as a computer program stored on a computer-readable medium. The medium may be a volatile or a non-volatile medium. The medium may also be a magnetic medium, such as a floppy disk, hard disk drive, or tape cartridge, an optical medium, such as an optical disc, and/or a semiconductor medium, like a random-access memory or a flash memory.

The controller 106 first causes the fluid-ejection mechanism 102 to output multiple-color fluid targets by varying the energy used to eject fluid drops of each fluid color of each fluid target (502), as has been described. Next, the controller 106 causes the scanning mechanism 104 to scan each fluid target to determine its chroma value (504). The controller 106 finally adjusts the energy used to eject fluid for each fluid color by determining the energy used to eject fluid for each fluid color within the fluid target having the minimum, or lowest, chroma value (506).

Other Exemplary Embodiments to Ensure Substantially Identical Fluid Drop Mass

In the exemplary embodiment of the invention described in the previous section of the detailed description, the grid 300 of multiple-color fluid targets 306 in FIG. 3 is generated by varying the energy used to eject fluid by the printheads 110 of the fluid-ejection mechanism 102. The most color-neutral target of the fluid targets 306 is identified. The different levels of energy employed to eject fluid by the printheads 110 within the most color-neutral target are then subsequently used to eject fluid, such that substantially identical fluid drop mass is ensured.

In another exemplary embodiment of the invention, however, the grid of multiple-color fluid targets 306 in FIG. 3 can be generated by varying the number of fluid drops of ink of each of the fluid colors of each of the targets 306, where the same level of energy is used to eject the fluid drops of each of the targets 306, for a given fluid color. That is, the amount of cyan fluid is adjusted over the columns 302 by varying the number of cyan fluid drops that are ejected within the targets 306 in each of the columns 302, without varying the fluid-ejection energy. Similarly, the amount of magenta fluid is adjusted over the rows 304 by varying the number of magenta drops that are ejected within the targets 306 in each of the rows 304, without varying the fluid-ejection energy.

For instance, the number of cyan fluid drops within the targets 306 in the column 302A may be lower than the number of cyan fluid drops within the targets 306 in the column 302B, the number of cyan fluid drops within the targets 306 in the column 302B may be lower than the number of cyan fluid drops within the targets 306 in the column 302C, and so on. Similarly, the number of magenta fluid drops within the targets 306 in the row 304A may be lower than the number of cyan fluid drops within the targets 306 in the row 304B, the number of magenta fluid drops within the targets 306 in the row 304B may be lower than the number of magenta fluid drops within the targets 306 in the row 304C, and so on. Therefore, in each of the multiple-color fluid-drop targets 306, there is a unique combination of the number of cyan fluid drops and the number of magenta fluid drops, even though the same fluid-ejection energy is used to eject the cyan fluid drops in each of the targets 306, and the same fluid-ejection energy is used to eject the magenta fluid drops in each of the targets 306.

As before, the sensing mechanism 104 is employed to determine the most color-neutral target of the multiple-color fluid targets 306. The number of fluid drops ejected for each fluid color within the most color-neutral target is compared to a reference number of fluid drops of the fluid color to ensure color neutrality. For example, the most color-neutral target may be the target in which eighty cyan fluid drops and forty magenta fluid drops were ejected. However, the reference number of fluid drops of each these colors may be fifty drops. Therefore, the energy used to eject fluid for each fluid color is adjusted based on the number of fluid drops ejected for the fluid color on the most color-neutral target, compared to the reference number of fluid drops that should have been ejected, to ensure color neutrality.

In the case where eighty cyan fluid drops are ejected on the most color-neutral target, this means that eighty cyan fluid drops had to be ejected to achieve color neutrality, where the reference number is much less, at fifty cyan fluid drops. Therefore, the energy used to eject a cyan fluid drop is increased, based on the comparison between the actual eighty cyan fluid drops on the most color-neutral target and the reference fifty cyan fluid drops, so that fifty cyan fluid drops in future cyan fluid ejections achieves color neutrality. Similarly, in the case where forty magenta fluid drops are ejected on the most color-neutral target, this means that forty magenta fluid drops had to be ejected to achieve color neutrality, where the reference number is greater, at fifty magenta fluid drops. Therefore, the energy used to eject a magenta fluid drop is decreased, based on the comparison between the actual forty magenta fluid drops on the most color-neutral target and the reference fifty magenta fluid drops, so that fifty magenta fluid drops in future magenta fluid ejections achieves color neutrality.

In one exemplary embodiment, a linear relationship between energy and fluid drop mass is employed to adjust the energy to eject a fluid drop based on the number of drops ejected on the most color-neutral target compared to a reference number of fluid drops, for each color of fluid. The adjustment can be represented as:

$$\text{Adjustment} = 100\% \times \frac{\text{Actual} - \text{Reference}}{\text{Actual}}, \quad (1)$$

where Adjustment is the percentage adjustment that is to be made to the fluid-ejection energy, Actual is the number of fluid drops actually ejected on the most color-neutral target, and Reference is the reference number of fluid drops that should have yielded color neutrality. In the case where eighty cyan fluid drops are ejected on the most color-neutral target, and the reference number of cyan fluid drops is fifty, the adjustment is $$100\% \times \frac{80 - 50}{80},$$

or an increase of 38%. In the case where forty magenta fluid drops are ejected on the most color-neutral target, and the reference number of magenta fluid drops is also fifty, the adjustment is $$100\% \times \frac{40 - 50}{40},$$

or a decrease of 25%. Assuming a linear relationship between energy and fluid drop mass may particularly be appropriate where the number of drops for a given fluid color on the most color-neutral target does not vary by too much from the reference number of drops.

Figure 6:
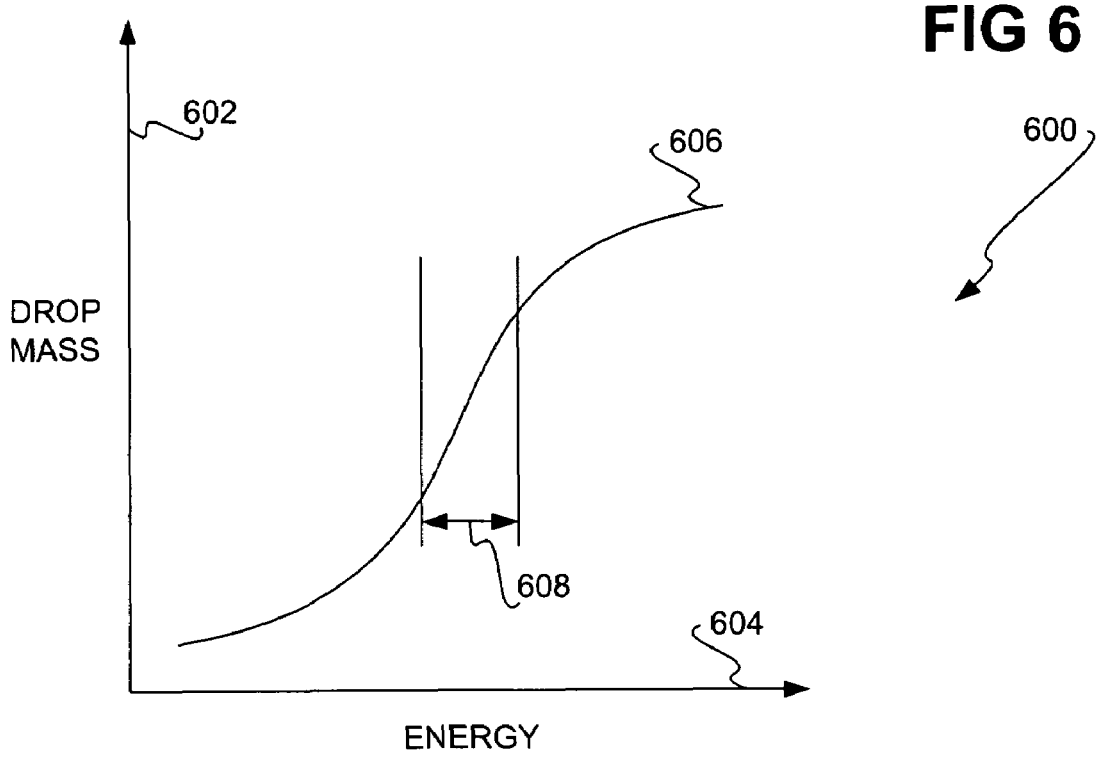
FIG. 6 is a graph of an example non-linear relationship between fluid drop mass and fluid-ejection energy, according to an exemplary embodiment of the invention.

In another exemplary embodiment, the relationship between energy and fluid drop mass is non-linear. FIG. 6 shows a graph 600 of an example non-linear relationship between fluid-ejection energy and fluid-drop mass, according to an embodiment of the invention. The y-axis 602 indicates fluid drop mass as a function of fluid-ejection energy on the x-axis 604. The line 606 is non-linear, such that a given percentage increase or decrease in fluid-ejection energy generally does not yield a corresponding percentage increase or decrease in fluid drop mass. However, it is noted that the middle portion 608 of the line 606 is in fact substantially linear.

The non-linear relationship between fluid-ejection energy and fluid-drop mass represented as the line 606 of the graph 600 can be utilized as follows to adjust fluid-ejection energy to achieve color neutrality. An initial point on the line 606 is known based on the fluid-ejection energy used to eject each of the drops in the most color-neutral multiple-color target. The Adjustment factor provided above when assuming a linear relationship between fluid-ejection energy and fluid drop mass instead is used to indicate how far to go up or down on the y-axis 602. Where a horizontal line drawn at this new level on the y-axis 602 intersects the line 606 therefore indicates the new fluid-ejection energy to be used to ensure color neutrality. Because the relationship between fluid-ejection energy and the fluid drop mass is non-linear, however, the corresponding point on the line 606 is not a corresponding percentage right or left on the x-axis 604 as compared to the Adjustment factor used to go up or down on the y-axis 602.

Figure 7:
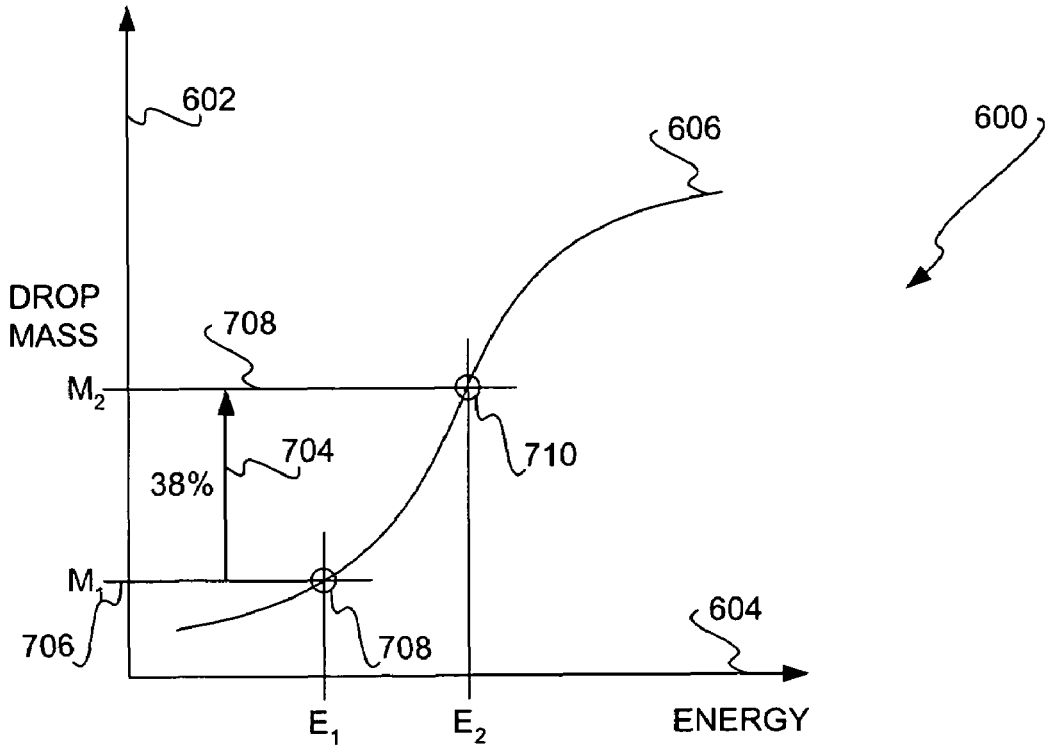
FIGS. 7 and 8 are graphs illustratively depicting how the example non-linear relationship of FIG. 6 may be employed to adjust fluid-ejection energy to yield substantially identical fluid drop masses, according to an exemplary embodiment of the invention.

For example, FIG. 7 shows how the example non-linear relationship between fluid drop mass and fluid-ejection energy, represented as the line 606 of the graph 600, may be used to determine the fluid-ejection energy needed to ensure color neutrality where eighty cyan drops are ejected on the most color-neutral target, and the reference number of cyan fluid drops is fifty, according to an embodiment of the invention. The initial point 702 provides the fluid drop mass $M_1$ for the fluid-ejection energy $E_1$ that is used to eject each of the eighty cyan drops on the most color-neutral target. Because eighty cyan drops is an increase of 38% over the number of reference cyan drops, fifty—i.e., the Adjustment factor previously described—the level 706 on the y-axis 602 is correspondingly increased by 38% to the level 708, as represented by the arrow 704. The new level 708 corresponds to the fluid drop mass $M_2$, and intersects the line 606 at the point 710. The corresponding fluid-ejection energy $E_2$ on the x-axis 604 at this point 710 is therefore the fluid-ejection energy to be used when ejecting cyan fluid drops to achieve color neutrality. It is noted that in all likelihood $$\frac{E_2 - E_1}{E_1} \neq 38\%,$$

since the relationship between fluid drop mass and fluid-ejection energy is non-linear, instead of being linear.

Figure 8:
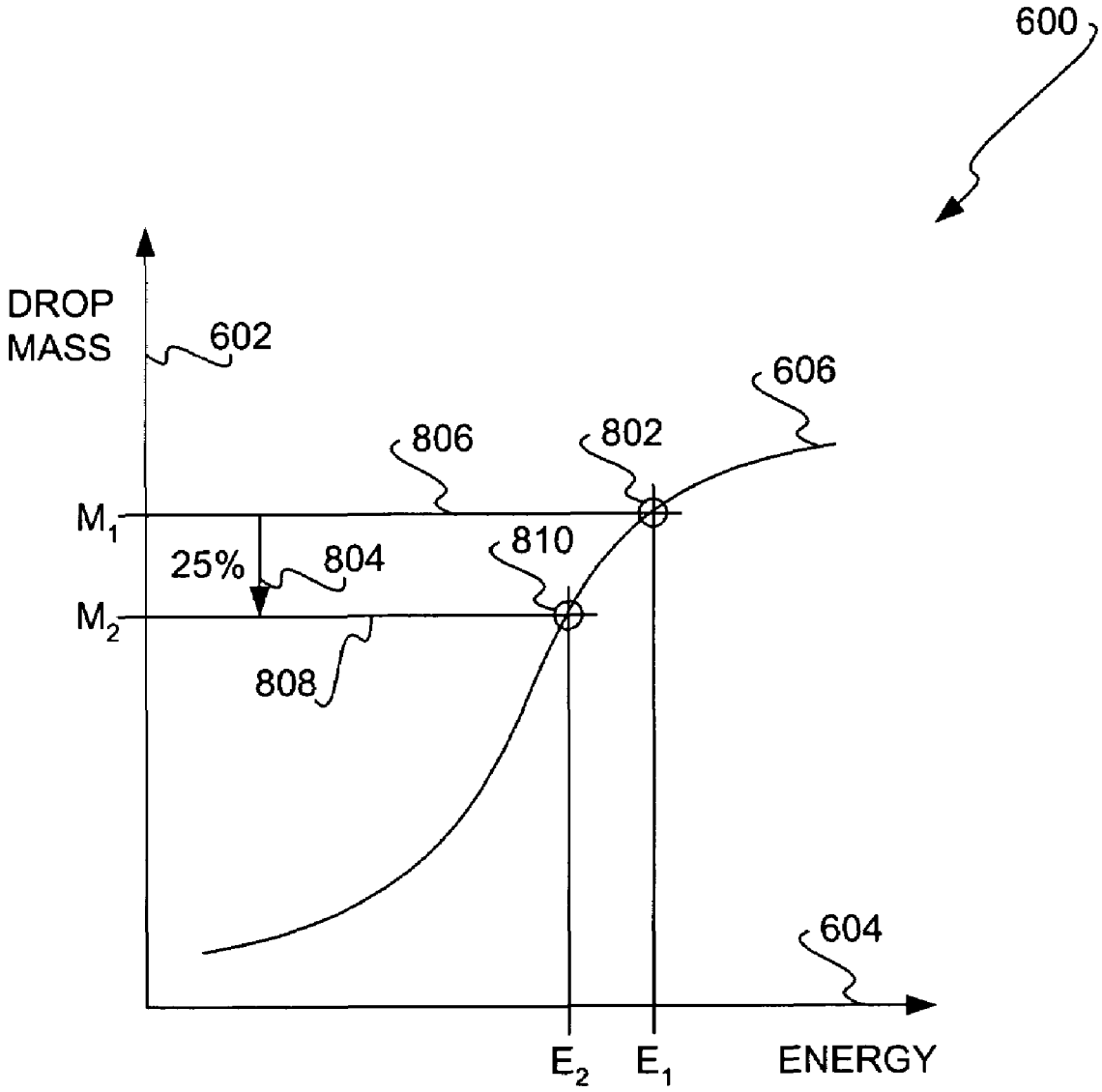

As another example, FIG. 8 shows how the example non-linear relationship between fluid drop mass and fluid-ejection energy, represented as the line 606 of the graph 600, may be used to determine the fluid-ejection energy needed to ensure color neutrality where forty magenta drops are ejected on the most color-neutral target, and the reference number of magenta drops is fifty, according to an embodiment of the invention. The initial point 802 provides the fluid drop mass $M_1$ for the fluid-ejection energy $E_1$ that is used to eject each of the forty cyan drops on the most color-neutral target. Because forty cyan drops is a decrease of 25% from the number of reference magenta drops, fifty—i.e., the Adjustment factor previously described—the level 806 on the y-axis 602 is correspondingly decreased by 25% to the level 808, as represented by the arrow 804. The new level 808 corresponds to the fluid drop mass $M_2$, and intersects the line 606 at the point 810. The corresponding fluid-ejection energy $E_2$ on the x-axis 604 at this point 810 is therefore the fluid-ejection energy to be used when ejection magenta fluid drops to achieve color neutrality. It is noted that in all likelihood $$\frac{E_2 - E_1}{E_1} \neq -25\%,$$

since the relationship between fluid drop mass and fluid-ejection energy is non-linear.

In one exemplary embodiment, the non-linear relationship between fluid drop mass and fluid-ejection energy is assumed as a given function. For instance, within a given fluid-ejection assembly and/or a given fluid-ejection device, the firmware thereof may store a function expressing the non-linear relationship between drop mass and energy. Such a function may have been determined at the factory or in laboratory conditions, or based on expected behavior of a given fluid-ejection mechanism and/or its constituent printheads and types of ink. Alternatively, the relationship between fluid drop mass and fluid-ejection energy may be determined dynamically, for a given fluid-ejection assembly and/or a given fluid-ejection device, such as either before or after generating the grid 300 of FIG. 3.

For example, the fluid-ejection assembly may include a fluid drop mass sensor that is able to measure the mass of a drop of fluid that has been ejected. The fluid drop mass sensor may be a drop-detect sensing mechanism, or another type of fluid drop mass sensor. A given printhead of the fluid-ejection assembly is caused to output fluid drops at different fluid-ejection energy levels. At each energy level, the drop mass of the ejected fluid drop is determined. Based on this data, the relationship between drop mass and fluid-ejection energy may be determined. For instance, the data may be stored within a table, and further data points may be interpolated from the data as needed. As another example, curve-fitting or other approaches may be used to mathematically express the non-linear relationship between drop mass and fluid-ejection energy.

Figure 9:
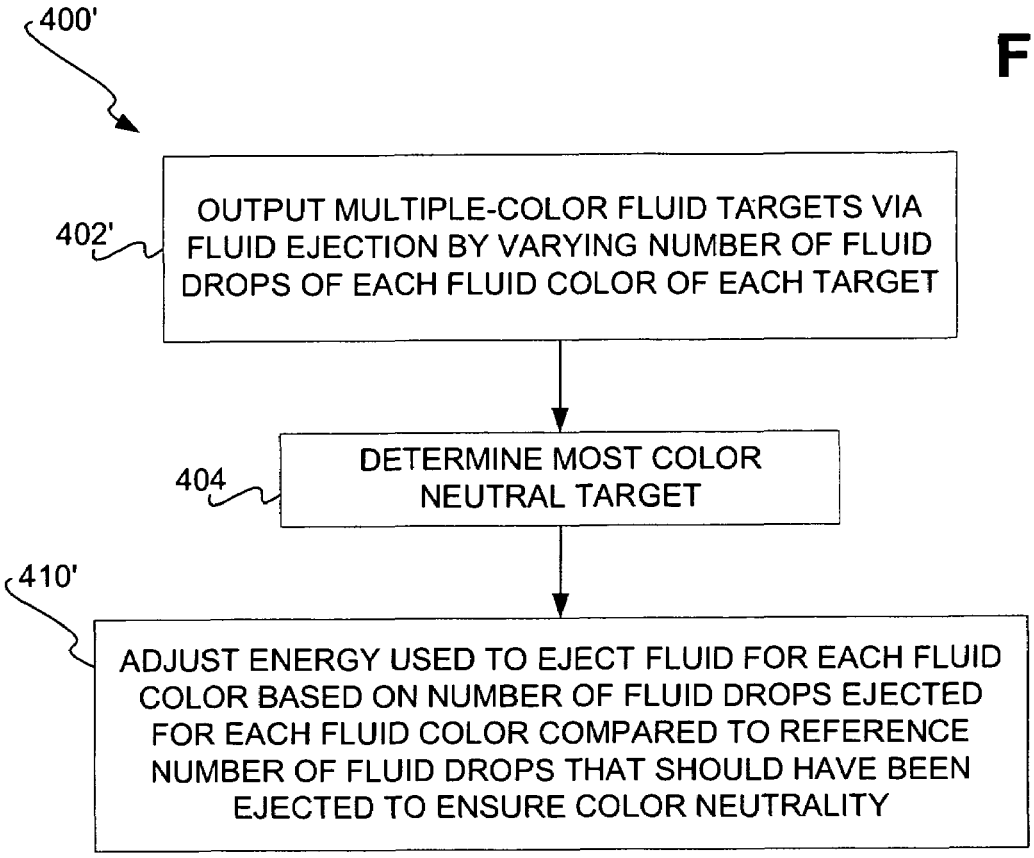
FIG. 9 is a flowchart of a method to adjust fluid-ejection energy to yield substantially identical fluid drop mass for different fluid colors that is different than the method of FIG. 4, according to an exemplary embodiment of the invention.

FIG. 9 shows a method 400' for adjusting fluid-ejection energy to yield substantially identical fluid drop masses that summarizes and generalizes the foregoing description, according to an exemplary embodiment of the invention. The method of FIG. 9 is denoted as the method 400' because it is a variation of the method 400 of FIG. 4 that has been described. Multiple-color fluid targets are output, via fluid ejection, by varying the number of fluid drops of each fluid color of each target (402'). 402' differs from 402 of FIG. 4 in that the number of fluid drops is varied in 402', whereas the fluid-ejection energy is varied in 402 of FIG. 4. The most color-neutral target is then determined (404), as has been described in relation to the method 400 of FIG. 4.

Finally, the energy used to eject fluid for each fluid color is adjusted, based on the number of fluid drops ejected for each fluid color compared to a reference number of fluid drops that should have been ejected to ensure color neutrality (410'). 410' differs from 410 in how the energy used to eject fluid for each fluid color is adjusted. 410' is performed as has been described in this section of the detailed description. A linear relationship may be assumed between fluid drop mass and fluid-ejection energy, or a non-linear relationship may be assumed or otherwise determined between fluid drop mass and fluid-ejection energy, as has been described.

Figure 10:
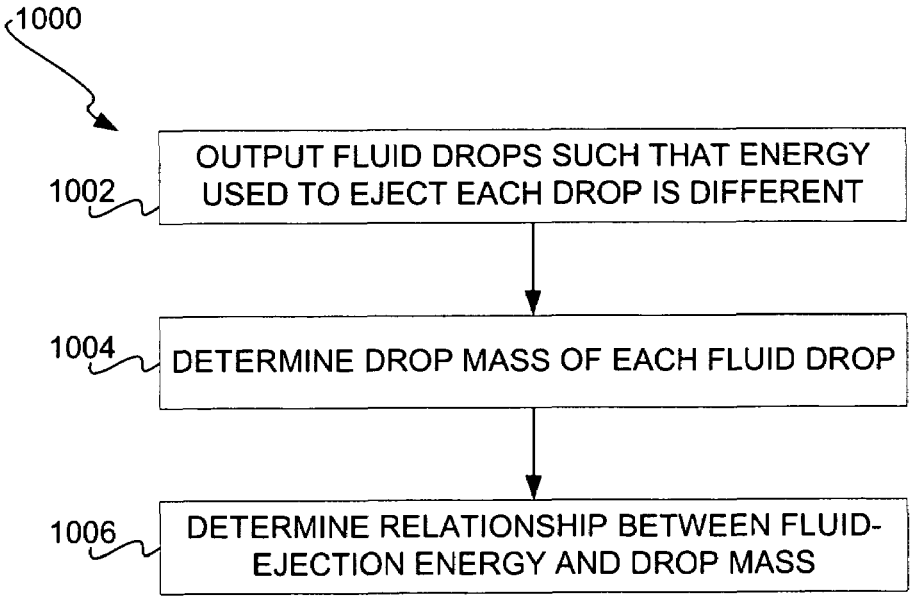
FIG. 10 is a flowchart of a method to determine the relationship between fluid-ejection energy and fluid drop mass, according to an exemplary embodiment of the invention.

For example, FIG. 10 shows a method 1000 for determining the relationship, non-linear or otherwise, between fluid drop mass and fluid-ejection energy for a given fluid color, according to an embodiment of the invention. Fluid drops are output, such that the energy used to eject each drop is different (1002). The drop mass of each fluid drop is determined as each drop of fluid is ejected (1004). From this information—the drop mass-energy pairs—the relationship between fluid-ejection energy and fluid drop mass is determined (1006). For instance, additional data points may be interpolated, or a function may be fitted onto the existing data points.

More General and Other Embodiments

The exemplary embodiments of the invention that have been described in the previous two sections of the detailed description in relation to FIGS. 3–9 adjust the energy used to eject fluid to ensure that fluid drop ejections yield substantially identical fluid drop masses. However, this is for exemplary purposes only, and does not reflect limitations on all embodiments of the invention. More generally, in other embodiments of the invention, the energy used to eject fluid is adjusted to ensure that fluid drop ejections yield fluid drop masses having a consistent ratio. That is, in the exemplary embodiment, the energy used to eject fluid is adjusted to yield substantially identical fluid drop masses, which means that the ratio between two such fluid drop masses is substantially 1:1. However, in other embodiments of the invention, the energy used to eject fluid can be adjusted to yield fluid drop masses having ratios other than 1:1, but where the ratios are still consistent, or otherwise substantially constant.

Furthermore, the exemplary embodiments of the invention have been described in the previous two sections of the detailed description in relation to FIGS. 3 and 9 as outputting multiple-color fluid targets via fluid ejection, and determining a most color-neutral target of these targets. The energy used to eject fluid to ensure that fluid drop ejections yield fluid drop masses having a consistent ratio is then adjusted based on the most color-neutral target. However, this is also for exemplary purposes only, and does not reflect limitations on all embodiments of the invention. More generally, in other embodiments of the invention, calibration factors are determined for a fluid-ejection mechanism capable of ejecting differently colored fluids, and the energy used to eject fluid is adjusted based on these calibration factors so that fluid drop ejections yield fluid drop masses having a consistent ratio.

That is, in the exemplary embodiment, the most color-neutral multiple-color fluid target is one calibration factor upon which basis the energy used to eject fluid can be adjusted to ensure that fluid drop ejections yield fluid drop masses having a consistent ratio. In one exemplary embodiment, then, outputting multiple-color fluid targets and determining the most color-neutral target is encompassed by determining calibration factors for a fluid-ejection mechanism. However, determining calibration factors for such a fluid-ejection mechanism, upon which basis the energy used to eject fluid is adjusted to ensure that fluid drop ejections yield fluid drop masses having a consistent ratio, can include determining factors other than the most color-neutral target.

Image-Forming Device and Conclusion

Figure 11:
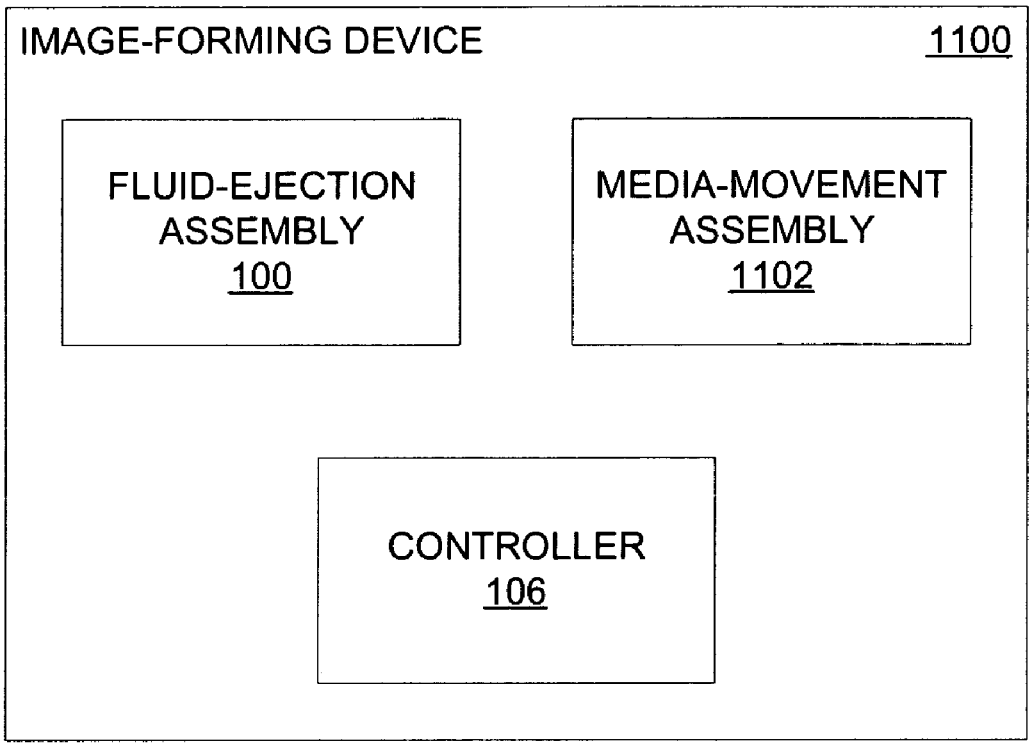
FIG. 11 is a block diagram of a rudimentary image-forming device, according to an embodiment of the invention.

FIG. 11 shows a rudimentary image-forming device 1100, according to an embodiment of the invention. The image-forming device 1100 is for forming images on media, and is specifically a fluid-ejection device, on account of its inclusion of the fluid-ejection assembly 100. For instance, the fluid-ejection assembly 100 may be an inkjet-printing assembly, such that the image-forming device 1100 is an inkjet-printing device. Besides the fluid-ejection assembly 100, the image-forming device 1100 includes a media-movement assembly 1102 and the controller 106, and may also include other components not depicted in FIG. 11. Although the controller 106 is depicted in the embodiment of FIG. 1 as being a part of the fluid-ejection assembly 100, in the embodiment of FIG. 11 the controller 106 is indicated as being separate from the assembly 100. The media-movement assembly 1102 includes motors, rollers, and other components to advance the media relative to the fluid-ejection assembly 100, so that the assembly 100 is able to eject fluid thereon for image formation.

The fluid-ejection assembly 100 is thus capable of ejecting differently color fluids onto media, and of sensing at least a chroma value of different parts of the media, as has been described. The controller 106 causes the fluid-ejection assembly 100 to output multiple-color fluid targets onto the media and to sense the chroma value of each target. The controller 106 also adjusts the energy used to eject each of one or more of the differently color fluids, based on the multiple-color fluid target having a minimum chroma value, as has also been described. Either the energy used to eject fluid drops of the differently colored fluids may vary over the fluid targets, or the number of fluid drops of the differently colored fluids may vary over the targets. Furthermore, the assembly 100 may include the printheads 110, such as inkjet printheads, and the sensing mechanism 104, such as an optical sensor, as has been described in relation to FIG. 1.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of embodiments of the present invention. Therefore, it is manifestly intended that this invention be limited only by the claims and equivalents thereof.

We claim:

1. A method comprising:

determining a plurality of calibration factors for a fluid-ejection mechanism capable of ejecting a plurality of differently colored fluids by outputting a plurality of multiple-color fluid targets via fluid ejection by varying a number of fluid drops ejected of each of the plurality of fluid colors of each multiple-color fluid target, each multiple-color fluid target having a different combination of a plurality of fluid colors; and, determining a most color-neutral target of the plurality of multiple-color fluid targets, such that the energy used to eject fluid for each of the at least one of the plurality of fluid colors is adjusted based on the most color-neutral target; and adjusting an enemy used to eject fluid for each of at least one of the plurality of fluid colors based on the plurality of calibration factors so that fluid drop ejections of the plurality of fluid colors yield fluid drop masses having a consistent ratio by determining the number of fluid drops elected for the fluid color on the most color-neutral target; and adjusting the energy used to eject the fluid for the fluid color based on the number of fluid drops ejected for the fluid color on the most color-neutral target compared to a reference number of fluid drops that should have been ejected to ensure color neutrality by adjusting the energy used to eject the fluid for the fluid color based on a linear relationship between energy and drop mass for the fluid color.

2. A method comprising:

determining a plurality of calibration factors for a fluid-ejection mechanism capable of ejecting a plurality of differently colored fluids by outputting a plurality of multiple-color fluid targets via fluid ejection by varying a number of fluid drops ejected of each of the plurality of fluid colors of each multiple-color fluid target, each multiple-color fluid target having a different combination of a plurality of fluid colors; and, determining a most color-neutral target of the plurality of multiple-color fluid targets, such that the energy used to eject fluid for each of the at least one of the plurality of fluid colors is adjusted based on the most color-neutral target; and adjusting an energy used to eject fluid for each of at least one of the plurality of fluid colors based on the plurality of calibration factors so that fluid drop ejections of the plurality of fluid colors yield fluid drop masses having a consistent ratio by determining the number of fluid drops ejected for the fluid color on the most color-neutral target; and adjusting the energy used to eject the fluid for the fluid color based on the number of fluid drops ejected for the fluid color on the most color-neutral target compared to a reference number of fluid drops that should have been ejected to ensure color neutrality by adjusting the energy used to eject the fluid for the fluid color based on an assumed relationship between energy and drop mass for the fluid color.

3. A method comprising:

determining a plurality of calibration factors for a fluid-ejection mechanism capable of ejecting a plurality of differently colored fluids by outputting a plurality of multiple-color fluid targets via fluid ejection by varying a number of fluid drops ejected of each of the plurality of fluid colors of each multiple-color fluid target, each multiple-color fluid target having a different combination of a plurality of fluid colors; and, determining a most color-neutral target of the plurality of multiple-color fluid targets, such that the energy used to eject fluid for each of the at least one of the plurality of fluid colors is adjusted based on the most color-neutral target; and adjusting an energy used to eject fluid for each of at least one of the plurality of fluid colors based on the plurality of calibration factors so that fluid drop ejections of the plurality of fluid colors yield fluid drop masses having a consistent ratio by determining the number of fluid drops ejected for the fluid color on the most color-neutral target; and adjusting the energy used to eject the fluid for the fluid color based on the number of fluid drops ejected for the fluid color on the most color-neutral target compared to a reference number of fluid drops that should have been ejected to ensure color neutrality by adjusting the energy used to eject the fluid for the fluid color based on a determined relationship between energy and drop mass for the fluid color.

4. The method of claim 3, wherein adjusting the energy used to eject the fluid for the fluid color based on the number of fluid drops ejected for the fluid color on the most color-neutral target compared to the reference number of fluid drops that should have been ejected to ensure color neutrality further comprises:

outputting a plurality of fluid drops of the fluid color such that the energy used to eject each of the plurality of fluid drops is different;

determining a drop mass of each of the plurality of fluid drops; and, determining the relationship between energy and drop mass for the fluid color based on the drop mass of each of the plurality of fluid drops and the energy used to eject each of the plurality of fluid drops.

* * * * *